US007610705B2

(12) United States Patent
Liu

(10) Patent No.: US 7,610,705 B2
(45) Date of Patent: Nov. 3, 2009

(54) DEER-SHAPED DECORATIVE STRUCTURE ASSEMBLY

(75) Inventor: Wenli Liu, Shanghai (CN)

(73) Assignee: Shanghai Ori-Adv Decoration Co., Ltd., Shanghai (CN)

( * ) Notice: Subject to any disclaimer, the term of this patent is extended or adjusted under 35 U.S.C. 154(b) by 400 days.

(21) Appl. No.: 11/247,467

(22) Filed: Oct. 11, 2005

(65) Prior Publication Data

US 2007/0006495 A1 Jan. 11, 2007

(30) Foreign Application Priority Data

May 18, 2005 (CN) ..... 2005 2 0041609 U

(51) Int. Cl.
*G09F 1/08* (2006.01)

(52) U.S. Cl. ..... 40/538

(58) Field of Classification Search ..... 40/538, 40/610

See application file for complete search history.

(56) References Cited

U.S. PATENT DOCUMENTS 5,451,436 A 9/1995 Shelleman
5,850,927 A * 12/1998 Pan ..... 211/181.1
6,394,282 B1 5/2002 Pan
6,413,594 B1 7/2002 Onishi
6,478,164 B1 11/2002 Pan
6,679,954 B1 1/2004 Takano et al.
6,758,001 B1 * 7/2004 Su ..... 40/538

* cited by examiner

*Primary Examiner*—Lesley D Morris
*Assistant Examiner*—Shin Kim
(74) *Attorney, Agent, or Firm*—Hamre, Schumann, Mueller & Larson, P.C.

(57) ABSTRACT

The present utility model provides a deer-shaped decorative structure assembly, comprising a body framework having a trunk and four legs, a head framework having a head and a neck, and an antler framework of an antler shape, the head framework being detachably connected to the body framework, the antler framework being detachably connected to the head framework, and the body framework, the head framework and the antler framework when assembled together forming an upstanding deer-shaped structure, wherein each of the four legs of the body framework is configured so as to be folded in a longitudinal direction of the leg so that the height of the body framework after the folding of the legs is reduced to about half of the height before the folding. Since the legs of the body framework are designed to be a foldable structure, the height of the deer-shaped structure, after disassembly, is considerably reduced, thereby reducing the packaging and transportation size and lowering the costs of transportation.

14 Claims, 4 Drawing Sheets

DEER-SHAPED DECORATIVE STRUCTURE ASSEMBLY

FIELD OF THE INVENTION

This utility model relates to a decorative article, and in particular to a detachable deer-shaped decorative structure assembly formed from metal wire frameworks.

BACKGROUND ART

Deer-shaped decorative structures are widely welcome nowadays, and are especially adapted for promoting festive air. At present, deer-shaped decorative structures have been made in a detachable assembly arrangement, which reduces the product volume in transportation. Usually, a deer-shaped decorative structure assembly is consisted of three parts: a body framework, a head framework and an antler framework, which can be assembled to form an upstanding deer-shaped structure. When being disassembled for packaging and transportation, the antler framework is detached from the head framework, and the head framework in turn is detached from the body framework. The head framework and the antler framework detached are disposed under the abdomen of the body framework, and thus the cubage of the packaging is reduced. However, the packaging and transportation dimension of such assembly design is still unsatisfactory, and the dimension of the article after disassembly is to be further reduced.

SUMMARY OF THE INVENTION

The present utility model aims to provide a deer-shaped decorative structure assembly which not only has a reduced packaging and transportation size, but also is of a simple construction and easy disassembling.

To achieve the above mentioned aim, the present utility model provides a deer-shaped decorative structure assembly, comprising a body framework having a trunk and four legs, a head framework having a head and a neck, and an antler framework of an antler shape, the head framework being detachably connected to the body framework, the antler framework being detachably connected to the head framework, and the body framework, the head framework and the antler framework when assembled together forming an upstanding deer-shaped structure, wherein each of the four legs of the body framework is configured so as to be folded in a longitudinal direction of the leg so that the height of the body framework after the folding of the legs is reduced to about half of the height before the folding.

In the deer-shaped structure assembly described above, each of the legs of the body framework may be formed from a metal wire bent into a planar form.

In the deer-shaped structure assembly described above, each of the legs of the body may comprise an upper leg portion formed integrally with the trunk and a lower leg portion separable from the upper leg portion, the lower leg portion being connected to the upper leg portion by means of a hinge so that the lower leg portion can pivot about the hinge relative to the upper leg portion thereby to achieve the folding of the leg.

In the deer-shaped structure assembly described above, for each of the hinges of the legs may be provided a locking member, which is configured so as to fasten adjoining parts of the metal wires forming the upper and lower leg portions thereby to prevent the lower leg portion from pivoting about the hinge relative to the upper leg portion.

In the deer-shaped structure assembly described above, the body framework may be provided, at a joint to the head framework, with at least two rings, and the head framework is provided, at positions corresponding to the rings, provided with a corresponding number of pins, which are configured so as to be inserted into the rings so that the head framework is swingably connected to the body framework.

In the deer-shaped structure assembly described above, on the body framework may be mounted an electric motor having an output shaft coupled to the head framework through a link mechanism, rotation of the output shaft of the motor driving the head framework to swing back and forth relative to the body framework, and the electric motor being mounted on the body framework in such a way that the output shaft extends downward ("downward" herein means the direction toward the earth) from the motor.

In the deer-shaped structure assembly described above, each of the legs of the body framework may have, at its bottom end, a ring formed from the metal wire.

In the deer-shaped structure assembly described above, the trunk of the body framework and the head framework may be both configured in a staggered folding structure so as to be foldable in a staggered manner.

In the deer-shaped structure assembly described above, the trunk of the body framework may comprise at least two shaping rings spaced apart in a fore and aft direction ("fore and aft direction" herein means the direction from the dear head to the dear tail parallel to the ground) and at least two side frames extending in a direction intersecting with the shaping ring, each of the shaping rings and each of the side frames being pivotally connected, at their intersecting points, to each other so as to form the staggered folding structure, and wherein between the at least two side frames may be provided, along a diagonal direction, a locking link, for maintaining the side frames in a developed state when fixedly engaged with the side frames, and allowing the body framework to be folded in the staggered manner when disengaged from the side frames.

In the deer-shaped structure assembly described above, the head framework may comprise a shaping ring, two side frames extending along a direction intersecting with the shaping ring, a center frame positioned between the two side frames and extending along a direction intersecting with the shaping ring, and a hooking member spaced apart from the shaping ring and fixed at one end of the center frame, the side frames and the center frame both extending between the shaping ring and the hooking member, the side frames and the center frame being pivotally connected, at their intersecting points with the shaping ring, to the latter so as to form the staggered folding structure, and wherein the side frame is maintained in a developed state when one end of each of the side frames is hooked to the hooking member, and the head framework is allowed to be folded in the staggered manner when the one end of each of the side frames is disengaged from the hooking member.

In the deer-shaped structure assembly described above, since the legs of the body framework are designed to be of a foldable structure, the height of the deer-shaped structure after disassembly is considerably reduced. Particularly, the height of the body framework is reduced to only half of the original size, whereby the packaging and transportation size of the article is reduced, and the cost of transportation is lowered.

Moreover, in the deer-shaped structure assembly according to the present utility model, since each leg of the body framework is form from the metal wire bent into the planar form, instead of a three-dimensional form, the thickness of the article can be reduced. The stability of the deer-shaped structure in standing posture can be enhanced by providing a ring formed from the metal wire at the bottom end of each leg, which forms a standing surface parallel to the ground.

In addition, in the deer-shaped structure assembly according to the the present utility model, the body framework and the head framework may be formed in a staggered folding structure, thereby reducing the thickness of the article after disassembling, which helps to further reduce the packaging and transportation size of the article.

A preferred embodiment according to the present utility model will be described in detail with reference to the accompanying drawings.

PREFERRED EMBODIMENT OF THE INVENTION

Figure 6:
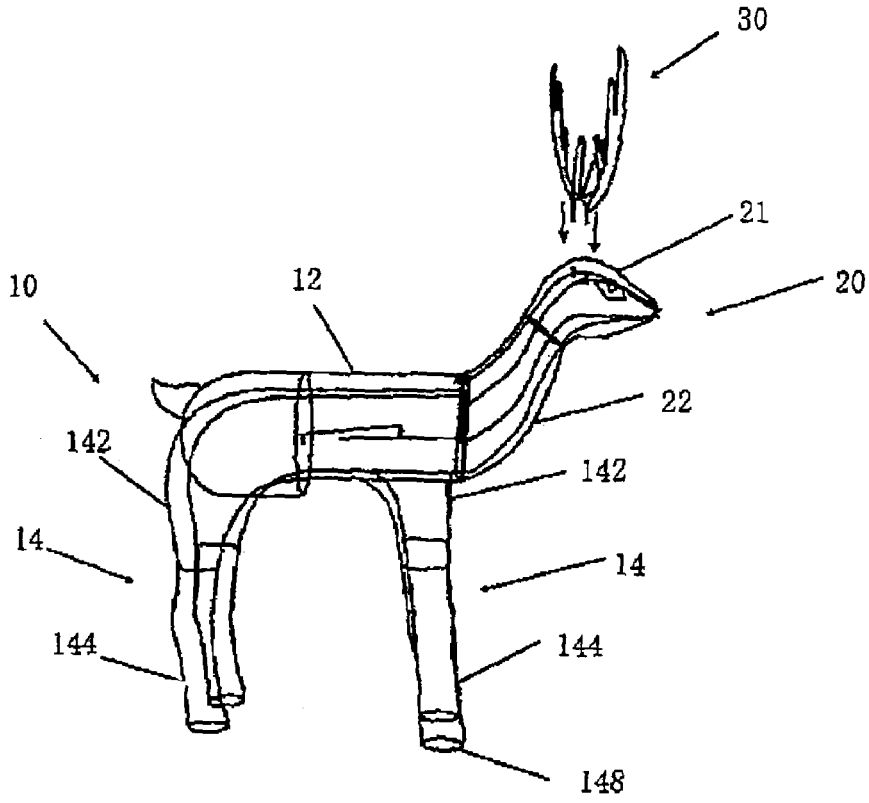
FIG. 6 is a side view of the deer-shaped decorative structure assembly in a substantially assembled state.

As can be clearly seen from FIG. 6, a deer-shaped decorative structure assembly according to the present utility model generally comprises three parts: a body framework 10, a head framework 20, and an antler framework 30. All the three parts are formed from metal wires, constituting a body, a head and an antler of a deer, respectively. The body framework 10 is fabricated having a trunk 12 and four legs 14. The head framework 20 is fabricated having a head 21 and a neck 22. The antler framework 30 is fabricated into the form of an antler. The head framework 20 is detachably connected with the body framework 10, and the antler framework 30 is detachably connected with the head framework 20. When assembled, the body framework 10, the head framework 20 and the antler framework 30 together form an upstanding deer-shaped structure.

Each leg 14 of the body framework 10 is formed from a metal wire bent into a planar form, instead of a three-dimensional form, which is helpful to reduce the thickness of the article. Each leg 14 is provided with a ring 148 formed of the metal wire at its bottom end, which may be, for example, made into an oval shape. Formation of the metal ring is intended for a more stable standing of the deer-shaped structure.

Figure 1:
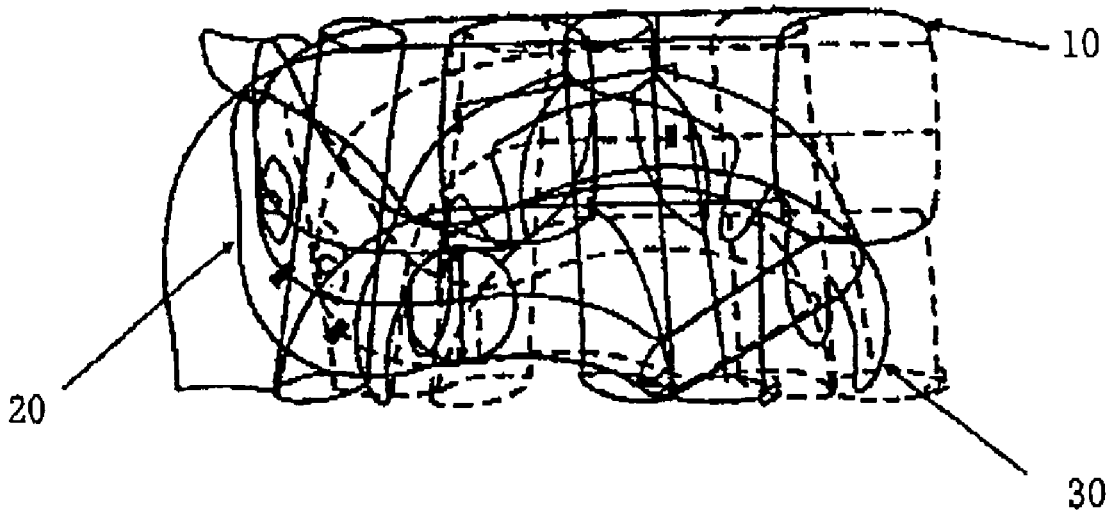
FIG. 1 is a side view of a deer-shaped decorative structure assembly according to a preferred embodiment of the present utility model in a state for packaging.

In FIG. 1, the deer-shaped decorative structure assembly according to the present utility model is in a state for packaging of the article after disassembling. In such a state, each of the legs 14 of the body framework 10 is folded along the longitudinal direction of the leg so that the height of the body framework after folding of the legs is reduced to half of its original size, and the trunk 12 of the body framework 10 is folded in a staggered manner into a flat shape. Thus, the entire structure is converted from an original solid structure into a flat folded structure. The body framework 10, the head framework 20 and the antler framework 30 are superposed together for packaging and transportation, and the space occupied is equivalent to a flat parallelepiped, hence it can be packaged by a flat parallelepiped case.

Figure 2:
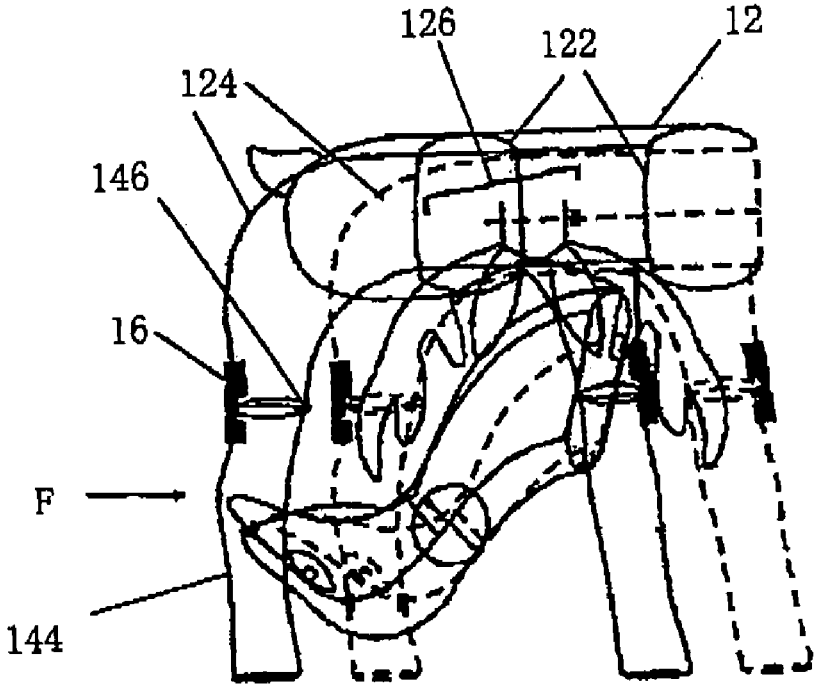
FIG. 2 is a side view of the deer-shaped decorative structure assembly shown in FIG. 1 with the legs developed.

FIG. 2 shows a developed state of the deer-shaped decorative structure assembly after the development of the legs 14. As shown clearly in FIG. 2, each leg 14 of the body framework 10 comprises an upper leg portion 142 formed integrally with the trunk 12 and a lower leg portion 144 separable from the upper leg portion 142. The lower leg portion 144 is jointed to the upper leg portion 142 through a hinge 146, so that the lower leg portion 144 can pivot about the hinge 146 relative to the upper leg portion 142 thereby to carry out the folding of the leg 14. The hinge 146 is mounted on a side corner where the metal wires of the upper leg portion 142 and the lower leg portion 144 adjoin, so that the lower leg portion 144 can pivot about the hinge 146 relative to the upper leg portion in the plane formed by the metal wires of the leg, i.e. pivot in the direction F in FIG. 2, thereby achieving the folding of the legs in their longitudinal directions.

At a position opposite to the hinge 146, that is on the other side corner where the metal wires of the upper leg portion 142 and the lower leg portion 144 adjoin, is provided a locking member 16, which is configured so as to be capable of fastening the adjoining parts of the metal wires of the upper leg portion 142 and the lower leg portion 144 to prevent the lower leg portion 144 from pivoting about the hinge 146 relative to the upper leg portion 142, thereby helping to maintain the leg 14 in the developed state. The locking member 16 may be a semi-cylindrical clamp, which can be hooked on the metal wire of the leg. Of course, other types of locking member may also be used, as long as they can achieve the similar locking function.

Figure 3:
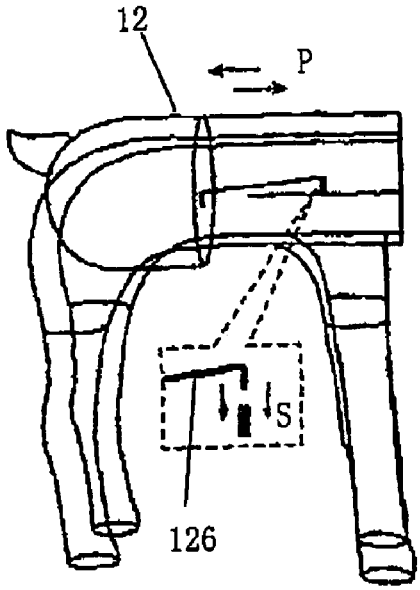
FIG. 3 is a side view of the deer-shaped decorative structure assembly shown in FIG. 2 with the body framework developed.

The trunk 12 comprises two shaping rings 122 spaced apart in the fore and aft direction and two side frames 124 extending in the direction intersecting with the shaping rings 122. The shaping ring 122 is a ring of a substantially rectangular shape, which is used to define the cross-sectional dimension of the trunk 12. The side frames 124 extend substantially in the fore and aft direction in the plane perpendicular to the ground, and are used to define the peripheries of the trunk 12 and the upper leg portion 142. The shaping ring 122 and the side frames 124 co-act with each other to substantially define the contour of the trunk. Each shaping ring 122 and each side frame 124 are pivotally jointed at their intersecting points. The pivotal joint is, for example, in the form of a pin/ring engagement. Of course, other types of pivot joints, such as hinge connections, may also be used. The shaping ring 122 and the side frames 124 jointed in such a manner constitute a staggered folding structure, which allows the side frames 124 and the shaping ring 122 to have a pivoting motion relative to each other, so that the relationship between the side frames and the shaping ring is converted from a substantially perpendicular state to a substantially parallel state. At the time of the conversion, the positions of the two side frames 124 are staggered in the fore and aft direction, as shown in FIG. 3 by arrows P. When they are transformed to the substantially parallel state, the entire body framework 10 is folded into a flat shape, thus greatly reducing the thickness of the article after disassembly.

Between the two side frames 124 is provided, in a diagonal direction, a locking link 126, one end of which is inseparably pivotally connected to one of the side frames 124, and the other end of which is separably connected to the other side frame. As shown in FIG. 3, when both ends of the locking link 126 are connected respectively to the two side frames 122, the body framework is prevented from the staggered folding, thereby maintaining the trunk in the developed state. When one end of the locking link 126 is disconnected from one side frame, the body framework 10 is allowed to be folded in the staggered manner. The inseparable pivotal connection of one end of the locking link 126 with one side frame 124 and the separable connection of its other end to the other side frame 124 may be carried out by a pin/ring joint, as shown in FIG. 3 by the arrow S. However, other suitable jointing modes may apply.

Figure 4:
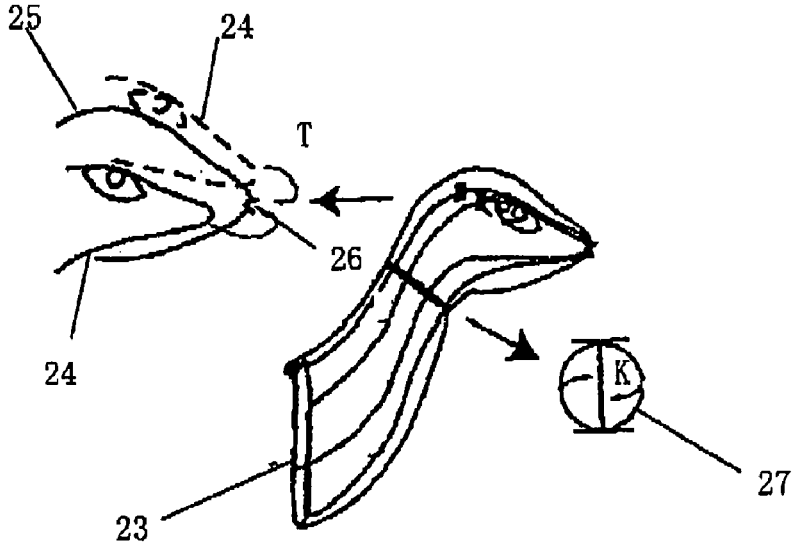
FIG. 4 is a side view showing how the head framework of the deer-shaped decorative structure assembly shown in FIG. 2 is developed.

FIG. 4 is a view showing the assembling of the head framework 20. The head framework 20 comprises a shaping ring 23, two side frames 24 extending along the directions intersecting with the shaping ring 23, a center framework 25 positioned between the two side frames 24 and extending along the direction intersecting with the shaping ring 23, and a hooking member 26 spaced apart from the shaping ring 23 and fixed at one end of the center frame 25. The side frame 24 and the center frame 25 extend between the shaping ring 23 and the hooking member 26, the side frame 24 and the center framework 25 are pivotally connected to the shaping ring 23 at their intersecting points with the latter to form a staggered folding structure. When one end of each of the side frames 24 is hooked to the hooking member, the side frames 24 are maintained in a developed state, and when one end of each of the side frames 24 is disengaged from the hooking member 26, the head framework is allowed to be folded in a staggered manner. The shaping ring 23 is used for defining the cross-section of the neck part 22 of the head framework 20, and the two side frames 24 and the center framework 25 successively define the profile of the head 21 and the neck 22 of the head framework 20.

When the front ends of both of the side frames 24 are disengaged from the hooking member 26 fixed at the front end of the center framework 25, the side frames 24 and the center framework 25 can pivot relative to the shaping ring 23, and then the side frames 24 and the center framework 25 can be converted from a substantially perpendicular relation to the shaping ring 23 to a substantially parallel relation to the shaping ring 23. At the same time of the conversion, each of the side frames 24 staggers relative to the center framework 25 in the fore and aft direction. When being converted to the substantially parallel relationship, the entire head framework 20 is folded into a flat shape, thus greatly reducing the thickness of the article after disassembly. When the front ends of both side frames 24 are hooked to the hooking member 26 at the front end of the center framework 25, as shown in FIG. 4 by arrow T, the side frames 24 and the center framework 25 can no longer pivot relative to the shaping ring 23, thus preventing the head framework 20 from folding in the staggered manner and maintain it in the developed state.

A support ring 27 of substantially circular shape may be provided at the interface of the head 21 and the neck 22 of the head framework 20. The support ring 27 is rotatably mounted on the center framework 25, as shown in FIG. 4 by K. When the head framework 20 is in the developed state, the support ring 27 turns to a position perpendicular to the plane of the center framework 25 in order to assist in supporting the two side frames 24 and holding the head framework in the developed state. When the head framework 20 is in the folded state, the support ring 27 turns to coincide with the plane of the center framework 25, so as not to add the folding thickness of the head framework.

Figure 5:
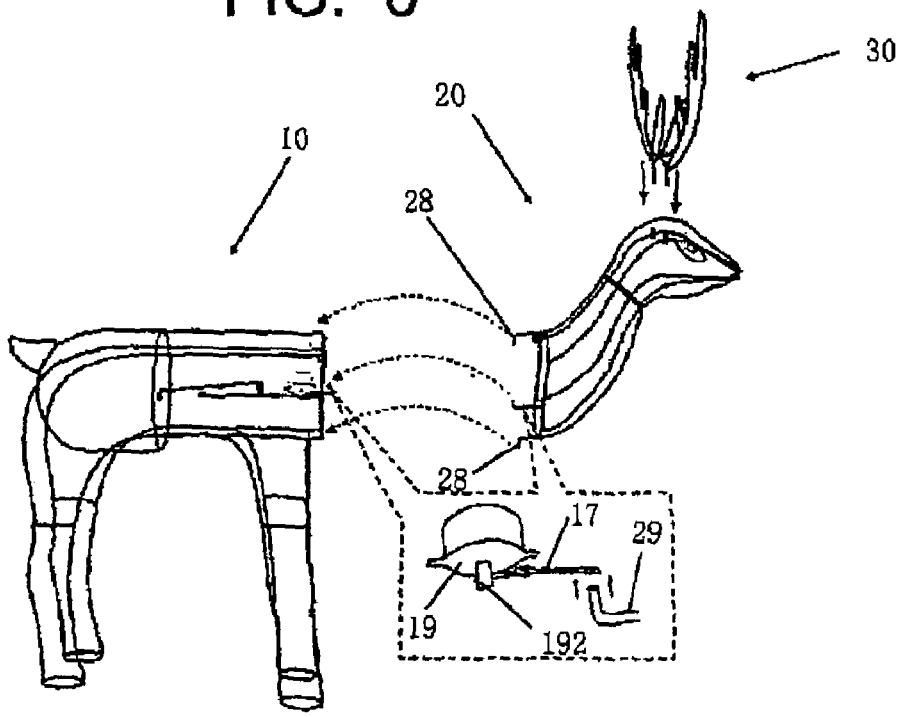
FIG. 5 is a side view showing how the head framework shown in FIG. 4 is joined to the body framework shown in FIG. 3.

Referring now to FIG. 5, two rings (not shown) are provided at the connecting position of the body framework 10 with the head framework 20, which may, for example, be fixed to one of the shaping rings 122 of the body framework 10, and two pins 28 are provided at positions of the head framework 20 corresponding to these rings, which may, for example, be fixed on the center framework 25. The pins 28 are inserted into the rings so that the head framework 20 is swingably connected to the body framework 10.

As shown in FIG. 5, on the body framework 10 adjacent to the head framework 20 may be mounted an electric motor 19, of which the output shaft 192 is coupled to a transmission pin 29 on the head framework 20 through a link mechanism 17. The transmission 29 may, for example, be fixed on the shaping ring 23 of the head framework 20. The rotation of output shaft 192 of the motor urges the head framework 20 to swing back and forth relative to the body framework 10 through the link mechanism 17 and the transmission pin 29. The electric motor 19 is mounted on the body framework with its output shaft 192 extending downward from the motor, so that liquid pollutants, such as rains, are prevented from leaking into the interior of the motor 19 and causing the failure of the electric motor. This facilitates the outdoor use of the article.

Figure 7:
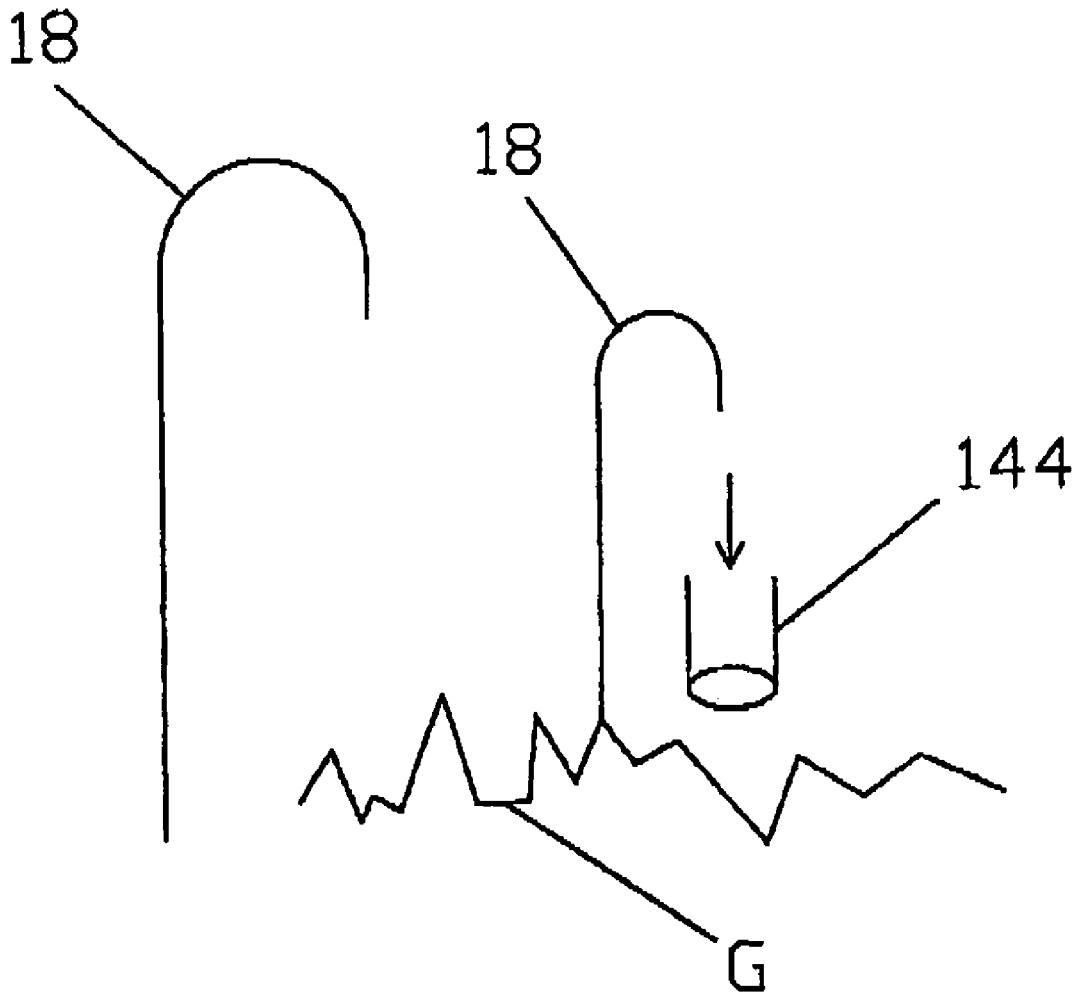
FIG. 7 is a view showing how the legs are fixed to the ground.

The deer-shaped structure can be stably fixed on the ground by means of a special device. As shown in FIG. 7, fixation bolts 18 are used for each leg of the deer-shaped structure. The fixation bolt 18 has a nail-shaped bottom end and a hook-shaped top end. The nail-shaped bottom end is adapted for inserting into the ground G (e.g. lawn), and the hook-shaped top end is adapted for hooking on the bottom of lower leg portion 144 of the deer-shaped structure. Accordingly, the deer-shaped structure can be securely fixed on the ground.

In addition, although not shown, strings of lighting bulbs or other decorations may be provided on the metal wires of the deer-shaped structure for promotion of the decorative effect.

What is claimed is:

1. A deer-shaped decorative structure assembly, comprising a body framework having a trunk and four legs, the trunk including at least one trunk shaping ring and at least two trunk side frames intersecting the trunk shaping ring at respective intersecting points, the trunk shaping ring and the trunk side frames being pivotably connected, the trunk shaping ring being pivotable relative to the trunk side frames to allow the trunk to pivot between an assembled trunk configuration with the trunk shaping ring being in a plane that is substantially perpendicular to the trunk side frames and a flat folded trunk configuration with the trunk shaping ring being in a plane that is substantially parallel to the trunk side frames, wherein a thickness of the flat folded trunk configuration is considerably less than a thickness of the assembled trunk configuration;

a head framework having a head and a neck, the head framework being detachably connected to the body framework; and an antler framework of an antler shape, the antler framework being detachably connected to the head framework, wherein the body framework, the head framework and the antler framework when assembled together form an upstanding deer-shaped structure, and wherein each of the four legs of the body framework is configured so as to be folded in a longitudinal direction of the leg so that the height of the body framework after the folding of the legs is reduced to about half of the height before the folding.

2. A deer-shaped decorative structure assembly of claim 1, wherein each of the legs of the body framework is formed from a metal wire bent into a planar form.

3. A deer-shaped decorative structure assembly of claim 1, wherein each of the legs of the body comprises an upper leg portion formed integrally with the trunk and a lower leg portion separable from the upper leg portion, the lower leg portion being connected to the upper leg portion by means of a hinge so that the lower leg portion can pivot about the hinge relative to the upper leg portion thereby to achieve the folding of the leg.

4. A deer-shaped decorative structure assembly of claim 3, wherein for each of the hinges of the legs is provided a locking member, which is configured so as to fasten adjoining parts of the metal wires forming the upper and lower leg portions thereby to prevent the lower leg portion from pivoting about the hinge relative to the upper leg portion.

5. A deer-shaped decorative structure assembly of claim 1, wherein the body framework is provided, at a joint to the head framework, with at least two rings, and the head framework is provided, at positions corresponding to the rings, provided with a corresponding number of pins, which are configured so as to be inserted into the rings so that the head framework is swingably connected to the body framework.

6. A deer-shaped decorative structure assembly of claim 5, wherein on the body framework is mounted an electric motor having an output shaft coupled to the head framework through a link mechanism, rotation of the output shaft of the motor driving the head framework to swing back and forth relative to the body framework, and the electric motor being mounted on the body framework in such a way that the output shaft extends downward from the motor.

7. A deer-shaped decorative structure assembly of claim 1, wherein each of the legs of the body framework has, at its bottom end, a ring formed from the metal wire.

8. A deer-shaped decorative structure assembly of claim 1, wherein the trunk of the body framework comprises at least two shaping rings spaced apart in a fore and aft direction and at least two side frames extending in a direction intersecting with the shaping ring, each of the shaping rings and each of the side frames being pivotally connected, at their intersecting points, to each other, and wherein between the at least two side frames is provided, along a diagonal direction, a locking link, for maintaining the side frames in the assembled trunk configuration when fixedly engaged with the side frames, and allowing the body framework to be folded when disengaged from the side frames.

9. A deer-shaped decorative structure assembly of claim 1, wherein the head framework includes at least one head shaping ring and at least two head side frames intersecting the head shaping ring at respective intersecting points, the head shaping ring and the head side frames being pivotably connected, the head shaping ring being pivotable relative to the head side frames to allow the head framework to pivot between an assembled head, configuration with the head shaping ring being in a plane that is substantially perpendicular to the head side frames and a flat folded head configuration with the head shaping ring being in a plane that is substantially parallel to the head side frames, wherein a thickness of the flat folded head configuration is considerably less than a thickness of the assembled head configuration.

10. A deer-shaped decorative structure assembly of claim 9, wherein the head framework comprises a shaping ring, two side frames extending along a direction intersecting with the shaping ring, a center frame positioned between the two side frames and extending along a direction intersecting with the shaping ring, and a hooking member spaced apart from the shaping ring and fixed at one end of the center frame, the side frames and the center frame both extending between the shaping ring and the hooking member, the side frames and the center frame being pivotally connected, at their intersecting points with the shaping ring, to the latter, and wherein the side frame is maintained in the assembled head configuration when one end of each of the side frames is hooked to the hooking member, and the head framework is allowed to be folded when the one end of each of the side frames is disengaged from the hooking member.

11. A deer-shaped decorative structure assembly, comprising:

a body framework having a trunk and four legs, the trunk including at least one trunk shaping ring and at least two trunk side frames intersecting the trunk shaping ring at respective intersecting points, the trunk shaping ring and the trunk side frames being pivotably connected, the trunk shaping ring being pivotable relative to the trunk side frames to allow the trunk to pivot between an assembled trunk configuration with the trunk shaping ring being in a plane that is substantially perpendicular to the trunk side frames and a flat folded trunk configuration with the trunk shaping ring being in a plane that is substantially parallel to the trunk side frames, wherein a thickness of the flat folded trunk configuration is considerably less than a thickness of the assembled trunk configuration;

a head framework having a head and a neck, the head framework being detachably connected to the body framework; and an antler framework of an antler shape, the antler framework being detachably connected to the head framework, wherein the body framework, the head framework and the antler framework when assembled together form an upstanding deer-shaped structure.

12. A deer-shaped decorative structure assembly of claim 11, wherein the trunk of the body framework comprises at least two shaping rings spaced apart in a fore and aft direction and at least two side frames extending in a direction intersecting with the shaping ring, each of the shaping rings and each of the side frames being pivotally connected, at their intersecting points, to each other so as to form the staggered folding structure, and wherein between the at least two side frames is provided, along a diagonal direction, a locking link, for maintaining the side frames in a developed state when fixedly engaged with the side frames, and allowing the body framework to be folded in the staggered manner when disengaged from the side frames.

13. A deer-shaped decorative structure assembly of claim 11, wherein the head framework includes at least one head shaping ring and at least two head side frames intersecting the head shaping ring at respective intersecting points, the head shaping ring and the head side frames being pivotably connected, the head shaping ring being pivotable relative to the head side frames to allow the head framework to pivot between an assembled head configuration with the head shaping ring being in a plane that is substantially perpendicular to the head side frames and a flat folded head configuration with the head shaping ring being in a plane that is substantially parallel to the head side frames, wherein a thickness of the flat folded head configuration is considerably less than a thickness of the assembled head configuration.

14. A deer-shaped decorative structure assembly of claim 13, wherein the head framework comprises a shaping ring, two side frames extending along a direction intersecting with the shaping ring, a center frame positioned between the two side frames and extending along a direction intersecting with the shaping ring, and a hooking member spaced apart from the shaping ring and fixed at one end of the center frame, the side frames and the center frame both extending between the shaping ring and the hooking member, the side frames and the center frame being pivotally connected, at their intersecting points with the shaping ring, to the latter, and wherein the side frame is maintained in the assembled head configuration when one end of each of the side frames is hooked to the hooking member, and the head framework is allowed to be folded when the one end of each of the side frames is disengaged from the hooking member.

* * * * *